US009563157B2

(12) United States Patent
Kato et al.

(10) Patent No.: US 9,563,157 B2
(45) Date of Patent: Feb. 7, 2017

(54) FIXING DEVICE HAVING SEPARABLE HEATING ROLLER HOLDING MEMBERS AND IMAGE FORMING APPARATUS THEREOF

(71) Applicants: Yuichiro Kato, Kanagawa (JP); Tsukasa Satoh, Kanagawa (JP); Yoshikuni Sasaki, Kanagawa (JP)

(72) Inventors: Yuichiro Kato, Kanagawa (JP); Tsukasa Satoh, Kanagawa (JP); Yoshikuni Sasaki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/171,977

(22) Filed: Feb. 4, 2014

(65) Prior Publication Data

US 2014/0270873 A1 Sep. 18, 2014

(30) Foreign Application Priority Data

Mar. 14, 2013 (JP) ..... 2013-052554

(51) Int. Cl.
*G03G 15/20* (2006.01)

(52) U.S. Cl.
CPC ..... *G03G 15/2053* (2013.01); *G03G 15/2064* (2013.01); *G03G 2215/2032* (2013.01)

(58) Field of Classification Search
CPC ..... G03G 15/2085; G03G 15/2071; G03G 15/2035; G03G 15/2067
USPC ..... 399/329, 122
See application file for complete search history.

(56) References Cited

U.S. PATENT DOCUMENTS

| | | | | |
|---|---|---|---|---|
| 4,595,274 | A * | 6/1986 | Sakurai | 399/331 |
| 8,280,289 | B2 * | 10/2012 | Yamanaka et al. | 399/323 |
| 2002/0193220 | A1 * | 12/2002 | Motegi et al. | 493/81 |
| 2006/0165446 | A1 * | 7/2006 | Kikuchi | G03G 15/2064 399/329 |
| 2009/0232550 | A1 * | 9/2009 | Obata | G03G 21/1685 399/122 |
| 2009/0245899 | A1 * | 10/2009 | Sato | 399/329 |
| 2009/0252520 | A1 * | 10/2009 | Segawa | 399/69 |
| 2010/0172671 | A1 * | 7/2010 | Onodera et al. | 399/122 |
| 2010/0239316 | A1 * | 9/2010 | Noso | 399/122 |

(Continued)

FOREIGN PATENT DOCUMENTS

| | | | | |
|---|---|---|---|---|
| JP | 08022208 A * | 1/1996 | | G03G 15/20 |
| JP | 2000-066541 | 3/2000 | | |

(Continued)

*Primary Examiner* — Walter L Lindsay, Jr.
*Assistant Examiner* — Arlene Heredia Ocasio
(74) *Attorney, Agent, or Firm* — Harness, Dickey & Pierce, P.L.C.

(57) ABSTRACT

A fixing device includes a fixing belt, a heating roller and a fixing roller over which the fixing belt is looped, a pressure roller forming a fixing nip with the fixing belt, a pair of side plates, one of the side plates being disposed on each end of a shaft of the fixing roller and each end of a shaft of the heating roller, and heating roller holding members to hold corresponding insulating bushing, and corresponding heating roller bearings, the heating roller holding members being attached to opening parts of the side plates. The heating roller holding members are formed of two separate components such that the heating roller is capable of moving along the opening parts formed in the side plates toward the fixing roller.

18 Claims, 5 Drawing Sheets

(56) References Cited

U.S. PATENT DOCUMENTS

| | | | | |
|---|---|---|---|---|
| 2011/0020033 | A1* | 1/2011 | Nagase | G03G 15/2064 399/122 |
| 2011/0236069 | A1* | 9/2011 | Arikawa et al. | 399/122 |
| 2013/0285329 | A1* | 10/2013 | Sykes | 277/314 |
| 2014/0086647 | A1* | 3/2014 | Hasegawa | G03G 15/2017 399/328 |
| 2014/0270875 | A1* | 9/2014 | Mimbu et al. | 399/329 |
| 2015/0248090 | A1* | 9/2015 | Yamamoto | G03G 15/2053 399/122 |

FOREIGN PATENT DOCUMENTS

| | | |
|---|---|---|
| JP | 2004-117395 | 4/2004 |
| JP | 2006-243029 | 9/2006 |
| JP | 2009-271178 | 11/2009 |
| JP | 2011-007977 | 1/2011 |
| JP | 2011-197019 | 10/2011 |
| JP | 2012-252116 | 12/2012 |

* cited by examiner

FIXING DEVICE HAVING SEPARABLE HEATING ROLLER HOLDING MEMBERS AND IMAGE FORMING APPARATUS THEREOF

BACKGROUND OF THE INVENTION

1. Field of the Invention

The disclosures herein relate to a fixing device and an image forming apparatus.

2. Description of the Related Art

In an image forming apparatus employing an electrophotographic system such as a printer, a copier, a facsimile machine, a multifunctional peripheral, and the like, a photoreceptor is initially charged by a charging device, a latent image is then formed on the photoreceptor by exposure of an original image or optically writing an image based on image information. The latent image is then developed by a developing device using toner to convert the latent image into a visible image, that is, a toner image, and then the toner image is transferred onto a recording sheet of paper serving as a transfer material. The sheet carrying merely transferred unfixed toner image is then passed through a fixing device to fix the unfixed toner image onto the sheet, and thus a copy or print of the image is obtained as a result.

A typical and well known fixing device used in such an image forming apparatus includes a fixing roller having a heat source (fixing roller having a built-in heater or self-heating fixing roller), a fixing belt looped over the fixing roller, and a pressure roller rotated by contacting the fixing belt or the fixing roller. In such a fixing device, the recording medium (transfer material) carrying the unfixed toner image is transferred by being sandwiched between the fixing roller and the pressure roller, where the fixing roller and the pressure roller pressure contact the unfixed toner image carried on the recording medium and the unfixed image is thus fixed to the recording medium. Further, it is also well-known in the art that a heating roller having an internal heater, and a tension roller applying tension to the fixing belt are disposed inside the fixing belt other than the fixing roller.

In such a fixing device, a belt of the fixing belt or a roller of the fixing roller is generally replaced with a new one when the belt or the roller is degraded or worn with time, or accidentally damaged. However, compared to the fixing roller, the fixing device having the fixing belt may exhibit a longer downtime because the fixing belt may require a longer replacing time or a roller may be damaged while the belt is replaced due to its complicated configuration.

The related art fixing device generally includes an integrated structure of heating roller holding members supporting a heating roller with a case or the like of the fixing device. In this configuration, to replace the fixing belt or the like, the heating roller holding members are removed from the case, and the heating roller is then removed from the fixing device. Further, after heating roller bearings and insulating bushing attached to a shaft of the heating roller are removed from the heating roller, the heating roller is drawn out from the fixing device, and the fixing belt and the fixing roller are detached thereafter.

Japanese Laid-open Patent Publication No. 2011-197019 (hereinafter referred to as "Patent Document 1"), for example, discloses a technology to form an endless belt unit in which a fixing belt is attached to opposite ends in an axial direction of reinforcement members, a fixing nip forming unit is inserted in an axial direction between the reinforcement members projected from side faces of a flange and the fixing belt, which forms the endless belt unit as a result. In this disclosed configuration, a flange of the endless belt unit is configured to be attached or detached with respect to a frame of the fixing device, which allows the endless belt unit to be attached or detached with respect to the frame of the fixing device. A nip forming unit is removed from a side of the flange of the endless belt unit detached from the frame of the fixing device.

However, the related art fixing device may require a longer time for replacing the belt or the like because the heating roller is removed only after the components attached to the shaft of the heating roller are removed. Further, the heating roller may need to be drawn out from the fixing belt in an axial direction before the fixing belt is detached. Hence, interference between the heating roller and the fixing belt while the heating roller is being drawn out may damage the fixing belt.

Further, in the technology disclosed in patent Document 1, a longer time may be required for inserting the flange of the endless belt unit into the frame of the fixing device in order to replace the fixing belt of the endless belt unit composed of the reinforcement member and the flange for attaching the fixing belt. The heating roller may need to be drawn out from the frame of the fixing device in an axial direction before the fixing belt is detached. Hence, interference between the heating roller and the fixing belt while the heating roller is being drawn out may damage the fixing belt.

Further, the heating roller may need to be drawn out from the fixing belt in an axial direction before the fixing belt is detached. Hence, interference between the heating roller and the fixing belt while the heating roller is being drawn out may damage the fixing belt. Moreover, in this configuration, a longer time may be required for replacing the fixing belt with a new one.

RELATED ART DOCUMENTS

Patent Document

Patent Document 1: Japanese Laid-open Patent Publication No. 2011-197019

SUMMARY OF THE INVENTION

Accordingly, it is a general object in one embodiment of the present invention to provide a fixing device capable of minimizing down time by improving replaceability of a fixing roller or a heating roller disposed on or inside a fixing belt, and an image forming apparatus having such a fixing device.

According to one aspect of the embodiment, there is provided a fixing device that includes a fixing belt; a heating roller and a fixing roller over which the fixing belt is looped; a pressure roller forming a fixing nip with the fixing belt; a pair of side plates, one of the side plates being disposed on each end of a shaft of the fixing roller and each end of a shaft of the heating roller; and two pairs of heating roller holding members configured to hold corresponding insulating bushing, the insulating bushing being attached to the corresponding ends of the shaft of the heating roller, and corresponding heating roller bearings, the heating roller bearings being attached to the corresponding ends of the shaft of the heating roller, the two pairs of the heating roller holding members being attached to opening parts of the side plates. In the fixing device, the heating roller holding members are formed of two separate components such that the heating roller is capable of moving along the opening parts formed in the side plates toward the fixing roller.

The object and advantages of the invention will be realized and attained by means of the elements and combinations particularly pointed out in the claims.

It is to be understood that both the foregoing general description and the following detailed description are exemplary and explanatory and are not restrictive of the invention as claimed.

Other objects and further features of the present invention will be apparent from the following detailed description when read in conjunction with the accompanying drawings.

DESCRIPTION OF THE PREFERRED EMBODIMENTS

In the following, a description will be given of embodiments of the present invention with reference to the accompanying drawings.

Image Forming Apparatus

Figure 1:
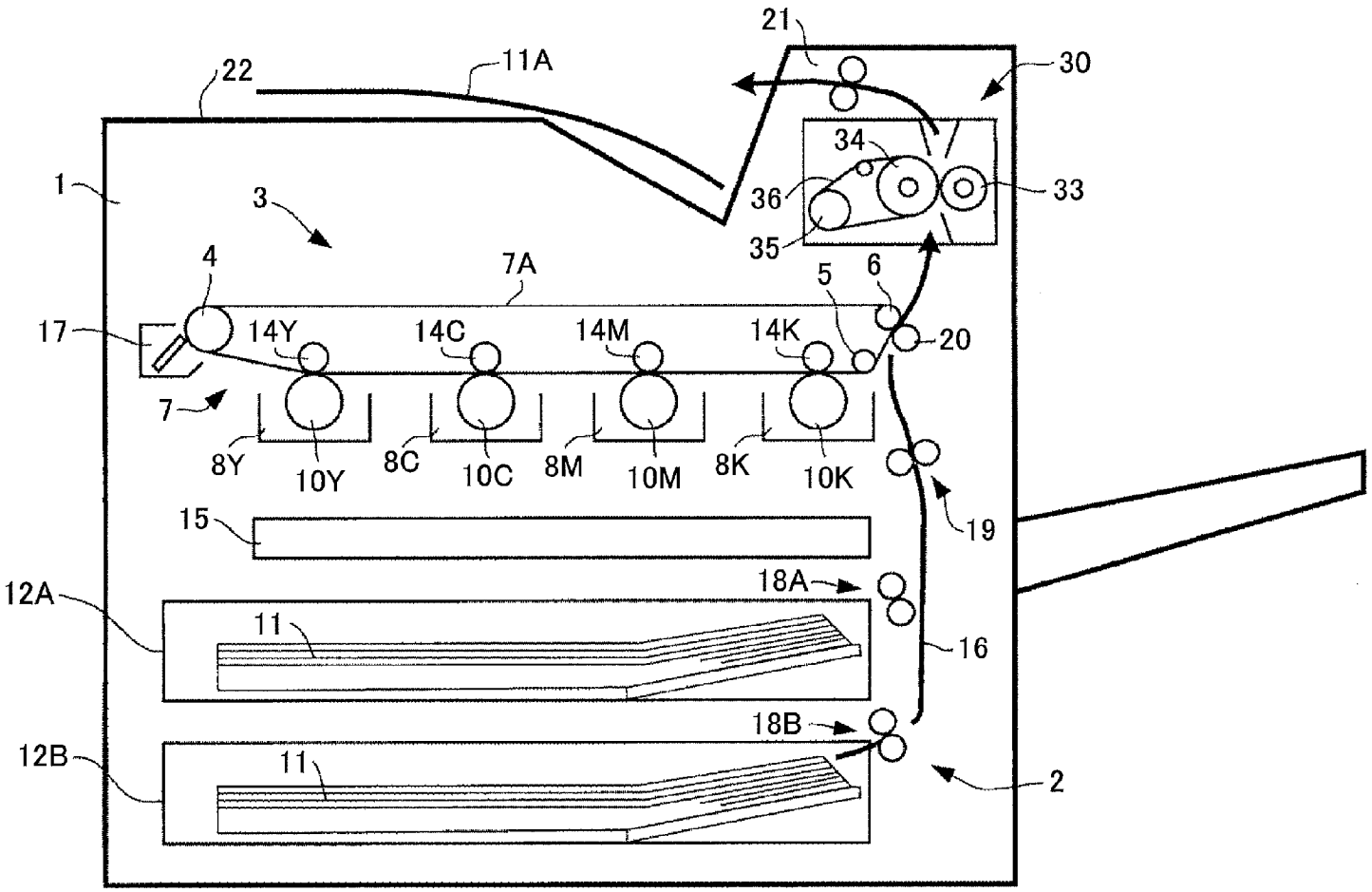
FIG. 1 is a schematic configuration diagram illustrating an image forming apparatus according to an embodiment.

FIG. 1 is a diagram illustrating a fundamental configuration of a printer (image forming apparatus) according to an embodiment. The printer includes a paper feeding part 2 having a plurality of paper feeding trays 12A and 12B located at a lower part of an image forming apparatus main body 1, and an image forming part 3 at an upper part of the image forming apparatus main body 1. The paper feeding trays 12A and 12B are each configured to store sheets 11 serving as recording media. The image forming part 3 includes image forming units 8Y, 8C, 8M, and 8K having respective photoreceptor drums 10Y, 10C, 10M, and 10K serving as image carriers, and an intermediate transfer unit 7 serving as an intermediate transfer body having an intermediate transfer belt 7A looped over rollers 4, 5, and 6. The image forming part 3 further includes a writing unit 15 configured to optically write information on each of the photoreceptor drums, and a fixing device 30 configured to fix an unfixed toner image T on the sheet 11. The image forming part 3 further includes a transport path 16 having a plurality of transport rollers between the paper feeding part 2 and the fixing device 30. The transport rollers are configured to transfer the sheets 11.

The image forming units 8Y, 8C, 8M, and 8K are detachably disposed with respect to the image forming apparatus main body 1. The image forming units 8Y, 8C, 8M, and 8K include the photoreceptor drums 10Y, 10C, 10M, and 10K, and further include respective charging devices, developing devices, and cleaning devices in the vicinity of the photoreceptor drums 10Y, 10C, 10M, and 10K. The respective developing devices are configured to store yellow, cyan, magenta, and black toner, and be supplied with supplemental toner from not-illustrated respective toner bottles when the toner is reduced.

The intermediate transfer belt 7A is disposed such that the intermediate transfer belt 7A faces the respective photoreceptor drums 10 (10Y, 10C, 10M, and 10K). The intermediate transfer belt 7A is configured to pivotally rotate in a counterclockwise direction as illustrated in FIG. 1. Transfer rollers 14 (14Y, 14C, 14M, and 14K) serving as a primary transfer unit are disposed inside the transfer belt 7A facing the respective photoreceptor drums 10Y, 10C, 10M, and 10K, such that primary transfer biases are applied to the transfer rollers 14Y, 14C, 14M, and 14K. A belt cleaning device 17 is disposed such that the belt cleaning device 17 faces the roller 4. The intermediate transfer belt 7A, the rollers 4 to 6, the transfer rollers 14 (14Y, 14C, 14M, and 14K), and the belt cleaning device 17 are integrally composed and detachably disposed with respect to the image forming apparatus main body 1.

A transfer roller 20 serving as a secondary transfer unit to which a secondary transfer bias is applied abuts a part of the intermediate transfer belt 7A that faces the roller 6. The transfer roller 20 and the part of the transfer belt 7A are configured to face a transport path 23 (see FIG. 2).

The writing unit 15 applies optically modulated laser light to respective surfaces of the photoreceptor drums 10Y, 10C, 10M, and 10K to form latent images of respective colors on the surfaces of the photoreceptor drums 10Y, 10C, 10M, and 10K. In the present embodiment, the writing unit 15 is disposed beneath the image forming units 8Y, 8C, 8M, and 8K such that laser light is emitted in a direction from the lower side of the image forming apparatus to the upper side of the image forming apparatus.

When image forming operations are initiated, the photoreceptor drums 10Y, 10C, 10M, and 10K of the image forming units 8Y, 8C, 8M, and 8K are rotationally driven in a counterclockwise direction by a not-illustrated drive unit. Hence, the surfaces of the photoreceptor drums 10Y, 10C, 10M, and 10K are each uniformly charged with a predetermined polarity by the respective charging devices. The charged surfaces of the photoreceptor drums 10Y, 10C, 10M, and 10K each receive laser light emitted from the writing unit 15, such that latent images are formed on the charged surfaces of the photoreceptor drums 10Y, 10C, 10M, and 10K. In this case, image information formed on the surface of each of the photoreceptor drums 10Y, 10C, 10M, and 10K by exposure of light is single color image information obtained as a result of decomposition of a full color image into yellow, cyan, magenta, and black color information. Thus formed latent images are formed as visualized toner images with toner by the respective developing devices when passing through an interval between the respective photoreceptor drums 10Y, 10C, 10M, and 10K and the respective developing devices.

When the intermediate transfer belt 7A is moved by the not-illustrated drive unit in a counterclockwise direction, the transfer roller 14Y transfers a yellow toner image formed by the image forming unit 8Y of the developing device having yellow toner located upstream of a belt moving direction. Then, the transfer rollers 14C, 14M, and 14K sequentially superimpose a cyan toner image, a magenta toner image, and a black toner image on the yellow toner image to form a full color toner image on the surface of the intermediate transfer belt 7.

Residual toner attached to the respective surfaces of the photoreceptor drums 10Y, 10C, 10M, and 10K after the toner images are transferred is removed from the surfaces by the respective cleaning devices. The respective surfaces of the photoreceptor drums 10Y, 10C, 10M, and 10K receive neutralization effects from not-illustrated static eliminators. As a result, the surface potentials are initialized such that the respective surfaces of the photoreceptor drums 10Y, 10C, 10M, and 10K are ready for next image formation.

On the other hand, each of the sheets 11 is fed from the paper feeding part 2 and transported in the transport path 16 by a rotationally driven paper feeding roller 18A or paper feeding roller 18B. Each of the transported sheets 11 is fed into an interval between the roller 6 and the transfer roller 20 that mutually face to each other at paper feeding timing by a registration roller pair 19 disposed more on a feeding side than the secondary transfer roller 20 in the transport path 16. At this moment, a transfer voltage has a polarity inverse to the toner charge polarity of the toner image on the surface of the intermediate transfer belt 7A. When the transfer voltage is applied to the transfer roller 20, the fill color toner image formed on the surface of the intermediate transfer belt 7A is integrally transferred onto the sheet 11.

The sheet 11 having the transferred full color toner image is transported to the fixing device 30, where the toner image is melted and the melted toner is fixed to the sheet 11. The sheet now 11A having the fixed toner image (see FIG. 2) is transported toward a discharge part 21 at an end of the transport path 23. The sheet 11A is then discharged from the discharge part 21 onto a discharge tray 22 disposed at an upper part of the image forming apparatus main body 1. The intermediate transfer belt 7A, after the toner image has been transferred onto the sheet 11, has residual toner, which is removed by the cleaning device 17.

Fixing Device

Figure 2:
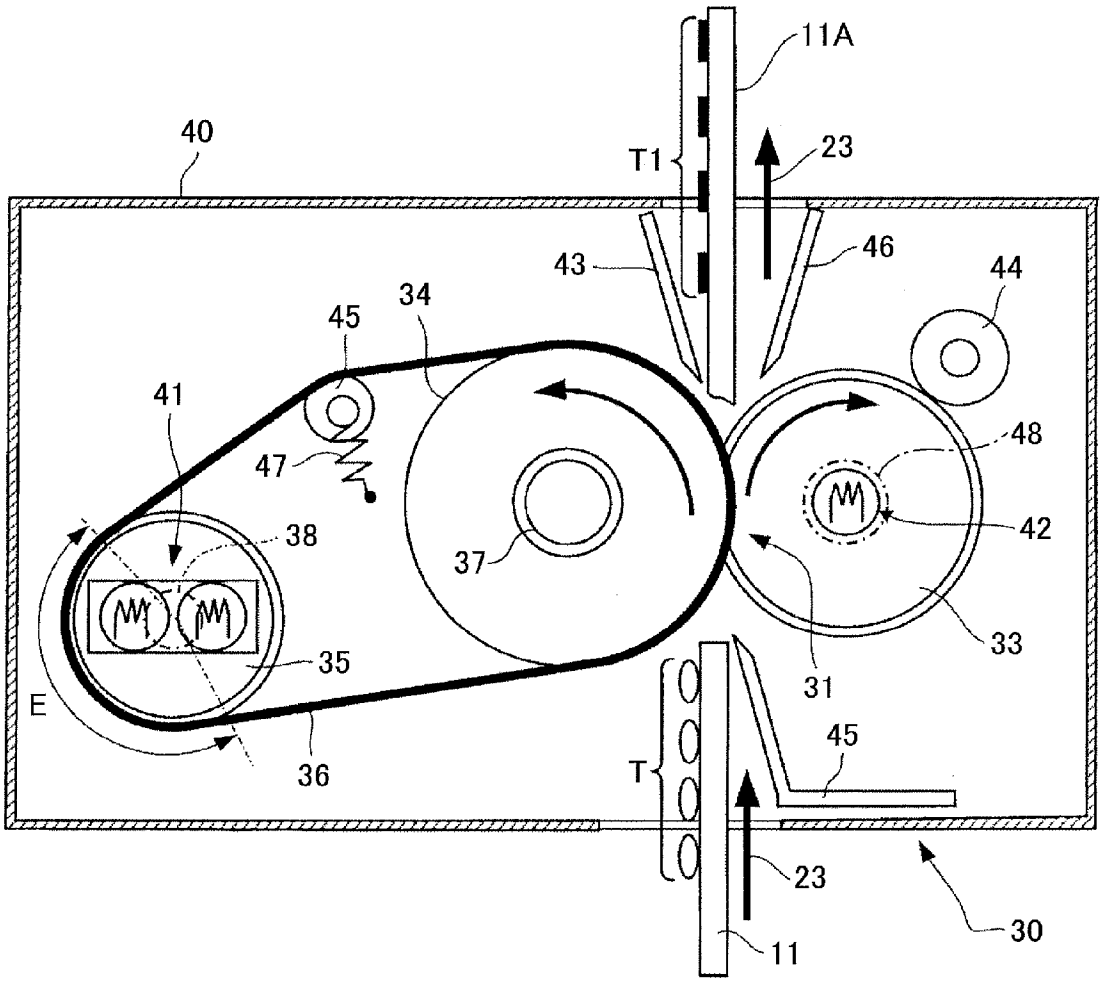
FIG. 2 is a schematic configuration diagram illustrating a fixing device according to an embodiment.

Next, a fundamental configuration of the fixing device 30 is described below. The fixing device 30 includes a fixing roller 34, a heating roller 35, and a tension roller 45 serving as rotators, and further includes a heat-resistant endless fixing belt 36 looped over the fixing roller 34, the heating roller 35, and the tension roller 45 as illustrated in FIGS. 1 and 2. The fixing device 30 further includes a pressure roller 33 serving as rotator configured to pressure contact the fixing roller 34, one of the rotators, via the fixing belt 36. The fixing device 30 is detachably disposed with respect to the image forming apparatus main body 1. The fixing device 30 is configured to fix an unfixed toner image T onto the sheet 11 by passing the sheet 11 through a nip part 31 formed between the fixing belt 36 and the pressure roller 33.

The fixing roller 34 and the heating roller 35 include shafts 37 and 38 having respective rotating centers rotationally fixed to a case 40 of the fixing device 30. The center distance between the fixing roller 34 and the heating roller 35 is configured to be constant. The tension roller 45 is disposed at an inner side of the fixing belt 36 such that a circumferential surface of the tension roller 45 is in contact with an inner circumference of the fixing belt 36. The tension roller 45 includes a spring 47 serving as an impelling member. The spring 47 is configured to correct the movement of the tension roller 45 in a direction from the inner side of the fixing belt 36 to the outer side of the fixing belt 36, and to apply tension to the fixing belt 36.

The fixing roller 34 is disposed on the transport path 23 side. The fixing belt 36 is looped over the fixing roller 34 and is disposed such that the outer surface of the fixing belt 36 faces the transport path 23. The fixing roller 34 is formed of an elastic body such as rubber. The heating roller 35 is formed of a metallic hollow roller, and includes a heater unit 41 serving as a heating source. In the present embodiment, the heater unit 41 is composed of a pair of heat generators disposed in a rotational axis direction of the heating roller 35. A halogen heater or the like may be used as each of the heat generators. The number of heaters is not limited to two. The number of heaters may be one, or three or more. The heating source is not necessarily disposed inside the heating roller 35, and may be disposed outside the heating roller 35 to heat the heating roller 35 from outside. The fixing roller 34 is configured to rotate, when being driven by a not-illustrated drive motor, in a counterclockwise direction to cause the fixing belt 36 to move in a direction identical to the rotating direction of the fixing roller 34.

The pressure roller 33 is configured to pressure contact the fixing roller 34 via the fixing belt 36, and be rotationally driven in a clockwise direction when the fixing belt 36 is moved. The pressure roller 33 is formed of a hollow roller, and includes a heater unit 42 as a heating unit. Hence the pressure roller 33 serves as a heating roller. The pressure roller 33 is rotationally supported by a shaft 48 with respect to the case 40, and is configured to be relatively displaced with respect to the fixing roller 34. The shaft 48 of the pressure roller 33 is configured to move in a horizontal direction (left and right) in FIG. 2. Hence the pressure roller 33 moves close to or away from the fixing roller 34 when the pressure roller 33 thermally expands or the thickness of the sheet 11 fluctuates. Further, the pressure roller 33 is configured to pressure contact a circumferential surface of the fixing roller 34 via the fixing belt 36 by a not-illustrated impelling unit such as a spring.

The fixing device 30 further includes a separator member 43 disposed at a position near where the fixing belt 36 is looped over the fixing roller 34 but away from the surface of the fixing belt 36. The separator member 43 is configured to separate from the surface of the fixing belt 36 the sheet 11A to which the toner image T1 is fixed while the sheet 11 is passing through the nip part 31. The separator member 43 in this embodiment is a plate-like member extending in a axial direction of the fixing roller 34. However, the separator member 43 may be formed in a pectinate-like shape.

The fixing device 30 further includes a cleaning member 44 configured to come into contact with the circumferential surface of the pressure roller 33 to remove paper-powder, toner and the like residing on the circumferential surface of the pressure roller 33. In the present embodiment, the cleaning member 44 is composed of a roller member extending in an axial direction of the pressure roller 33.

The fixing device 30 further includes sheet guide members 45 and 46 attached to the case 40 on the pressure roller 33 side. The sheet guide members 45 and 46 are respectively disposed upstream and downstream of a paper transport direction with respect to the nip part 31. The sheet guide member 45 is disposed close to a sheet introducing port for introducing the sheet 11 into the fixing device 30 that is formed in the case 40. The sheet guide member 45 is configured to guide the sheet 11 onto which the toner image T is transferred to the nip part 31. The sheet guide member 46 is disposed close to a sheet discharging port for discharging the sheet 11 from the fixing device 30 that is formed in the case 40. The sheet guide member 46 is attached to the case 40, and faces the separator member 43 via the transport path 23, such that a distance between the sheet guide member 46 and the separator member 43 broadens toward the sheet discharging port formed in the case 40. The fixing device 30 is attached to the image forming apparatus main body 1 such that respective positions of the sheet introducing port and the sheet discharging port match the transport path 23. The case 40 is configured to cover the fixing belt 36 looped over the fixing roller 34 and the heating roller 35, the pressure roller 33, the separator member 43, and the sheet guide members 45 and 46. Hence, the components covered with the case 40 are prevented from being directly touched by an operator or being affected by extraneous factors.

Figure 3:
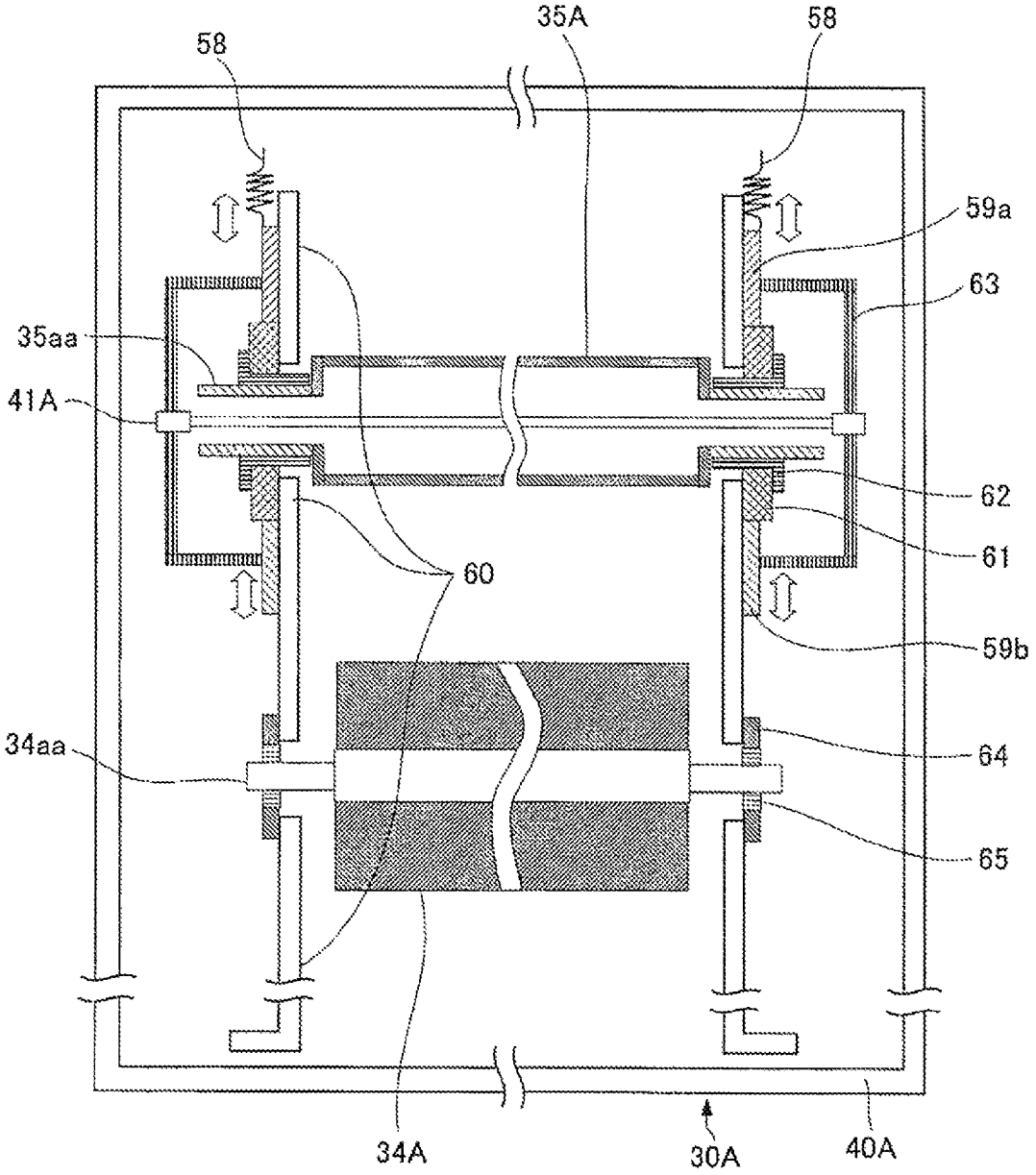
FIG. 3 is a diagram illustrating an example of the fixing device according to the embodiment.
Figure 4:
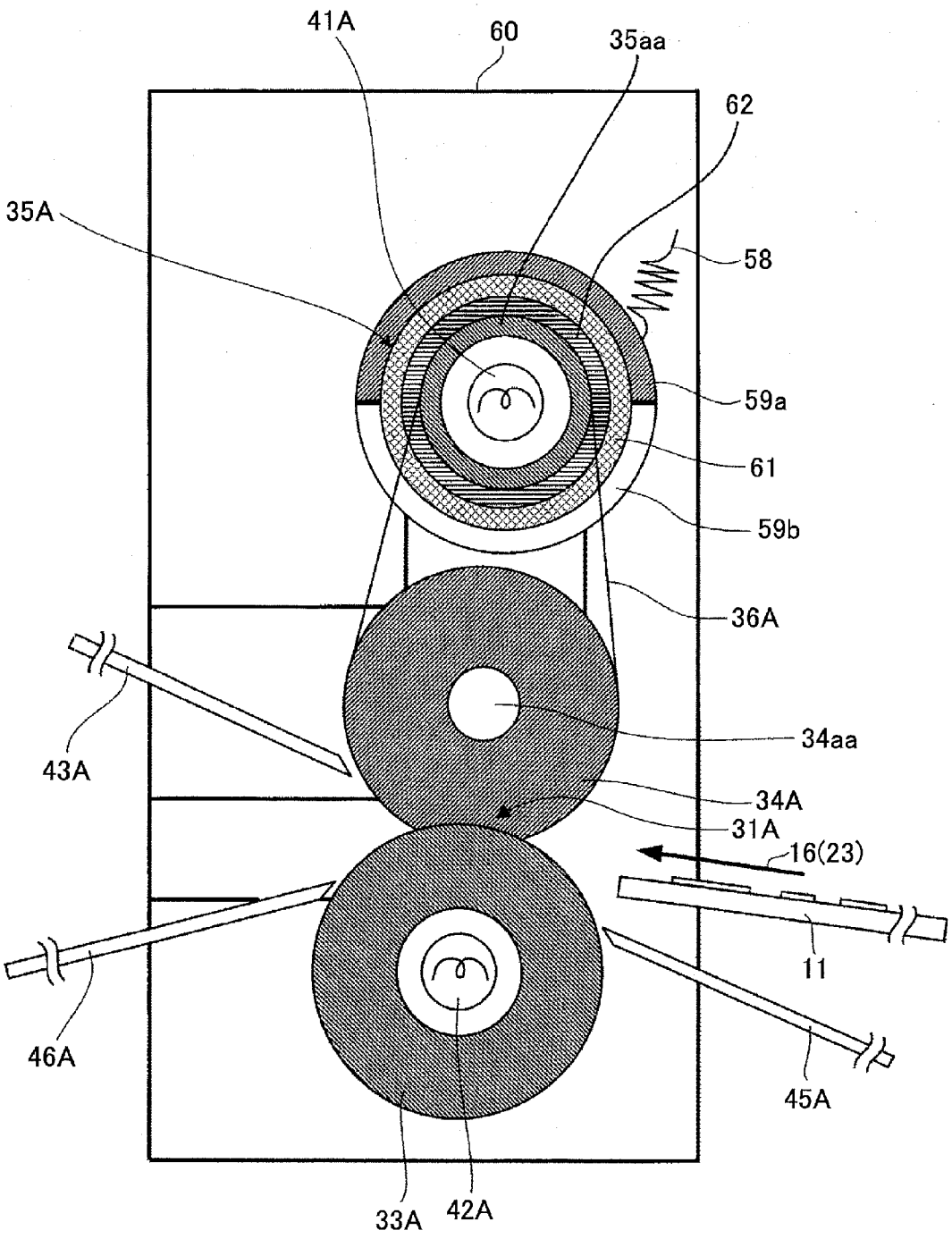
FIG. 4 is a diagram illustrating an example of the fixing device according to the embodiment.
Figure 5:
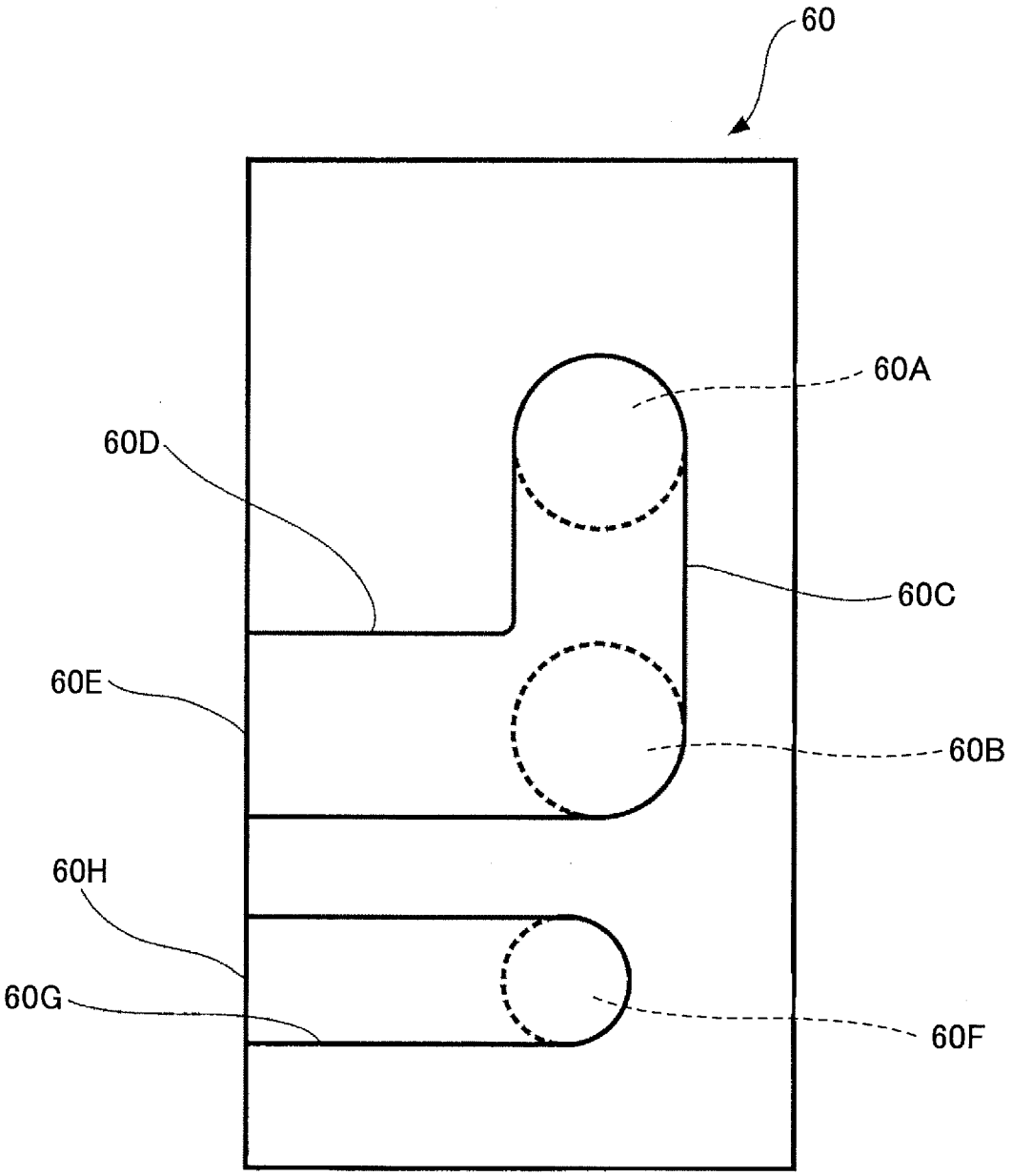
FIG. 5 is a diagram illustrating an example of the fixing device according to the embodiment.

A description is given below of a detailed configuration of a fixing device 30A according to an embodiment. FIG. 3 is a schematic cross-sectional diagram illustrating the fixing device 30A according to the embodiment. FIG. 4 is a schematic side diagram illustrating the fixing device 30A according to the embodiment. FIG. 5 is a diagram illustrating a configuration of a side plate 60 disposed inside the fixing device 30A according to the embodiment.

In the following, the embodiment of the fixing device 30A is described with reference to FIGS. 3, 4, and 5. FIGS. 3, 4, and 5 are schematic configuration diagrams illustrating the fixing device 30A according to the embodiment. As illustrated in FIG. 4A, the fixing device 30A includes a fixing belt 36A serving as a fixing member that is looped over a fixing roller 34A and a heating roller 35A. The fixing device 30A differs from the fixing device 30 illustrated in FIGS. 1 and 2 in that the fixing roller 34A is disposed beneath the heating roller 35A. The heating roller 35A includes a heater 41A having a heat source such as a halogen lamp. The heating roller 35A serves as a heater on the fixing roller 34A side. The halogen lamp is configured to warm up quickly and uniformly heat all of the fixing belt 36A. Further, the fixing roller 34A is connected to a not-illustrated drive source such that the fixing roller 34A serves as a drive roller to circulate the fixing belt 36A. Note that alternatively, a pressure roller 33A forming a fixing nip 31A via the fixing roller 34A and the fixing belt 36 may serve as the drive roller. The heating roller 35A is configured to outwardly press the fixing belt 36A by impelling units 58 such as springs to apply tension to the fixing belt 36A. That is, the heating roller 35A serves as a tension roller for the fixing belt 36A. With this configuration, the number of components forming the fixing device 30A may be reduced, which may improve replaceability of the components.

Alternatively, a not-illustrated tension roller may be disposed inside the fixing belt 36A or outside the fixing belt 36A to apply tension to the fixing belt 36A. The fixing belt 36A is heated by the heating roller 35A to a temperature at which an unfixed toner image on the sheet 11 is softened or melted. The pressure roller 33A includes a heater 42A configured to heat the pressure roller 33A. The heater 42A serves as a pressuring side heater.

The sheet 11 onto which the toner image is transferred is guided by a sheet guide member 45A and transported toward the fixing nip 31A. The toner image on the sheet transported to the fixing nip 31A is heated and pressed, and as a result, the toner image is fixed to the sheet 11. The sheet 11 having passed through the fixing nip 31A is separated by a separator member 43A from the fixing belt 36A. The sheet 11 separated from the fixing belt 36A is guided by a sheet guide member 46A and discharged from the fixing device 30A to outside.

FIG. 3 is a schematic cross-sectional diagram illustrating a cross section of the heating roller 35A, the fixing roller 34A, and other components associated with the heating roller 35A and the fixing roller 34A in the fixing device 30A. The fixing device 30A is covered with a case 40A, and side plates 60 are fixed to the case 40A. Hence, the fixing device 30A is configured such that the side plates 60 hold opposite ends of the fixing roller 34A, and opposite ends of the heating roller 41A. In this embodiment, two side plates 60 are disposed such that the side plates 60 support corresponding ends of the heating roller 35A and the fixing roller 34A. There are two pairs of heating roller holding members 59*a* and 59*b*. Each pair of the heating roller holding members 59*a* and 59*b* is disposed on a corresponding one of the two side plates 60. The heating roller holding members 59*a* and 59*b* are configured to pivotally support opposite ends of a hollow shaft 35*aa* of the heating roller 35A. The heating roller holding members 59*a* and 59*b* are splittably connected in a unified manner using a connecting member such as a screw. The heating roller holding members 59*a* and 59*b* are configured to outwardly press the fixing belt 36A by the impelling units 58 such as springs to apply tension to the fixing belt 36A. The heating roller 35A is guided and held by the heating roller holding members 59*a* and 59*b*, and the side plates 60 via insulating bushing 62 and heating roller bearings 61 such that movements of the heating roller 35A in axial directions are controlled. Further, heater holding members 63 are attached to the heating roller holding members 59*a* and 59*b*, respectively. In this configuration, the heating roller 35A, the insulating bushing 62, the heating roller bearings 61, and the heating roller holding members 59*a* and 59*b* cooperate with one another such that the fixing side heater 41A may be moved. The heater holding members 63 hold and supply heating power to the respective ends of the heater 41A of the heating roller 35A. Further, the heater holding members 63 simultaneously move with the heating roller 35A and the heating roller holding members 59*a* and 59*b* when the heating roller 35A is moved by an elastic member such as springs in a fixing nip direction. In this configuration, the heating roller 35A may be heated in a stable manner. The heater holding members 63 are detachably configured with respect to the heating roller holding members 59*a* and 59*b* by unfastening a fixing member such as a screw or being disengaged from fitting parts formed in the heating roller holding members 59*a* and 59*b*.

The fixing roller 34A includes fixing roller bearings 65 configured to axially support opposite ends of the fixing roller 34A, and fixing roller holding members 64 configured to hold and fasten the fixing roller bearings 65 to the side plates 60 using fastening members such as screws. The fixing roller holding members 64 may each have sizes large enough to cover opening parts 60B formed in the corresponding side plates 60 illustrated in FIG. 5. Each of the side plates 60 includes an opening part 60A corresponding to the heating roller 35A, an opening part 60B, and a cutout part 60C connecting the opening parts 60A and 60B.

FIG. 4 is a diagram illustrating arrangements of the fixing roller 34A, the heating roller 35A, the fixing belt 36A, the sheet guide members 45A and 46A, and the separator member 43A in the fixing device 30A.

FIG. 5 is a diagram illustrating a configuration of a side plate 60 having opening parts and cutout parts. The side plate 60 includes the opening part 60A for holding the heating roller 35A, the opening part 60B for holding the fixing roller 34A, the cutout part 60C for connecting the opening parts 60A and 60B, and a cutout part 60D for connecting the opening part 60B and a capturing part 60E. The side plates 60 having the same configuration are disposed on opposite ends of a shaft of the heating roller 35A and opposite ends of a shaft of the fixing roller 34A inside the case 40A of the fixing device 30A. The opening part 60A is larger than an outer diameter of the insulating bushing 62 of the heating roller 35A. Each of the opening part 60B, the cutout parts 60C and 60D, and the capturing part 60E has a width dimension within which the insulating bushing 62 is movable. Hence, the heating roller 35A, from which the heating roller holding members 59*b* are removed, may be movable by making the width of the cutout part 60C greater than the outer diameter of the insulating bushing 62 of the heating roller 35A. Further, in the opening part 60B of the side plate 60 corresponding to the fixing roller 34A, the fixing roller 34A, from which the fixing roller holding members 64 are removed, may temporarily be disposed in the opening part 60B of the side plate 60 via the shaft of the fixing roller 34A, and may further be movable along the cutout part 60D of the side plate 60. After the fixing roller 34A is moved, the fixing roller 34A, the heating roller 35A, and the fixing belt 36A may simultaneously be detached from the side plate 60, and the detached fixing roller 34A, heating roller 35A, and fixing belt 36A may simultaneously be removed from the capturing hole 60E by moving the heating roller 35A toward the fixing roller 34A side. Then, the fixing roller 34A, the heating roller 35A, and the fixing belt 36A may simultaneously be removed from a not-illustrated opening part of the fixing device 30A. Thereafter, the heating roller 35A and the fixing roller 34A are removed from the fixing belt 36A. The fixing belt 36A is then replaced with a new fixing belt. The sheet guide members 45A and 46A, and the separator member 43A that are attached to the case 40A of the fixing device 30A are detachably configured such that the sheet guide members 45A and 46A, and the separator member 43A may be removed and replaced with new ones, respectively, during maintenance of the fixing device 30A.

Since the heating roller need not be drawn out from the fixing belt in an axial direction before the fixing belt is detached, machine downtime due to deficiency in the market or due to replacement of components may be reduced, and improving replaceability of the components by preventing damage to the fixing belt caused by interference between the heating roller and the fixing belt while the heating roller is being drawn out or pulled out.

The side plate 60 may further include an opening part 60F for attaching the pressure roller 33A, a capturing hole 60H, and a cutout part 60G for communicating between the opening part 60F and the capturing part 60H.

The heating roller 35A is located with respect to the side plate 60 in a direction in which the fixing belt 36A is stretched by an impelling unit such as the spring 58. When one of the heating roller holding members 59*a* and 59*b*, that is, the heating roller holding member 59*b* is removed, tension of the fixing belt 36A looped over the heating roller 35A is relaxed in an amount in which the heating roller 35A is downwardly moved in a gutter of the opening part 60A of the side plate 60. The heating roller 35A may be movable by allowing the tension of the fixing belt 36A to be relaxed and allowing the insulating bushing 62 to pass through the opening part 60A of the side plate 60. The heating roller holding members 59*a* and 59*b* are configured such that the heating roller holding members 59*a* and 59*b* are separated in a circumferential direction of the hollow shaft 35*aa* of the heating roller 35A. After the heating roller holding members 59*a* and 59*b* are separated, the heating roller holding member 59*b* is removed by further moving the heating roller holding member 59*b* in an axial direction from the circumferential direction of the hollow shaft 35*aa* of the heating roller 35A. In this manner, the fixing belt 36A may be moved downward along the side plate 60 of the heating roller 35A, which may facilitate replacement of the fixing belt 36A. Further, the heating roller holding members 59*a* and 59*b* are configured such that the heating roller holding members 59*a* and 59*b* are stretched by an impelling unit 58 such as the spring. With this configuration, the heating roller 35A may also serve as a tension roller of the fixing belt 36A, which may save space, reduce the number of components, and improve replaceability of the fixing belt 36A.

FIG. 5 is a diagram illustrating an example of the embodiment. The heating roller holding members 59*a* and 59*b* are disposed by allowing the heating roller holding members 59*a* and 59*b* to be contact with the side plate 60 of the fixing device 30A. The heating roller holding members 59*a* and 59*b* are coupled with screws or the like, and are configured to outwardly press the fixing belt 36A by the impelling unit 58 such as a spring to apply tension to the fixing belt 36A. The heating roller 35A is held by the heating roller holding members 59*a* and 59*b* via the insulating bushing 62 and the heating roller bearings 61. Further, the heater holding members 63 are attached to the heating roller holding members 59*a* and 59*b*, respectively. In this configuration, the heating roller 35A, the insulating bushing 62, the heating roller bearings 61, and the heating roller holding members 59*a* and 59*b* cooperate with one another such that the heater 41A may be moved. In the fixing process, it may be possible to suppress fluctuation of the fixing nip 31A. The heater holding members 63 are removed from the heating roller holding members 59*a* and 59*b* when the components are detached for when the maintenance of the heating roller 35A is performed. It may be unnecessary to increase a diameter of the shaft of the heating roller 35A having the heater 41A by allowing the heater 41A to follow the positions of the heating roller holding members 59*a* and 59*b*, and the diameter of the shaft of the heating roller 35A may be minimized. Hence, a uniform amount of heat may be applied to the heating roller 35A.

When the heating roller holding member is integrally formed, it may be necessary to remove the fixing belt 36A and the fixing roller 34A after the heating roller bearings 61, the insulating bushing 62, and the heating roller 35A in the axial direction for replacing the fixing belt 36A. In a case where the heating roller holding members 59*a* and 59*b* are formed as two separate components as illustrated in the present embodiment, it may be possible to downwardly move the fixing belt 36A, the heating roller 35A, and the fixing roller 34A collectively to remove the fixing belt 36A, the heating roller 35A, and the fixing roller 34A simultaneously by detaching the heating roller holding member 59*a* from the heating roller holding member 59*b*. It may be unnecessary to draw or pull the heating roller 35A in the axial direction at the time of replacing the heating roller 35A. Hence, it may be possible to collectively remove or detach the fixing belt 36A, the fixing roller 34A, and the heating roller 35A, thereby improving the replaceability of the heating roller 35A.

The heating roller holding members 59*a* and 59*b* are, as illustrated in FIG. 4, configured such that heating roller holding members 59*a* and 59*b* are separated in a vertical direction (i.e., upward and downward directions) in FIG. 4 by removing a not-illustrated fastening member such as a screw. The separate heating roller holding members 59*a* and 59*b* may be taken out in the axial direction of the heating roller 35A. Since the heating roller holding members 59*a* and 59*b* are easily removed, downtime may be effectively reduced. The shaft 35*aa* of the heating roller 35A is downwardly moved in the opening part 60A of the side plate 60. The opening parts 60A and 60B and the cutout parts 60C and 60D of each of the side plates 60 form shaft end moving guide parts of the heating roller 35A and the fixing roller 34A.

The diameter of the shaft 34*aa* of the fixing roller 34A is generally smaller than the diameter of the hollow shaft 35*aa* of the heating roller 35A incorporating the heater 41A. Hence, it may be necessary to form the cutout parts 60C and 60D in the side plate 60 large enough for allowing the heating roller 35A and the fixing roller 34A to pass through the cutout parts 60C and 60D of the side plate 60 illustrated in FIG. 5 in order to remove the heating roller 35A and the fixing roller 34A via the cutout parts 60C and 60D for replacing the fixing belt 36A. Thus, the fixing roller holding members 64 configured to hold the shaft 34*aa* of the fixing roller 34A are disposed corresponding to the opening parts 60B serving as fixing roller 34A attaching parts of the side plate 60 for covering the common cutout parts having enlarged width dimensions. It may be possible to stably attach the fixing roller 34A in the opening part 60B of the side plate 60 by disposing the fixing roller holding members 64. Further, in this configuration, it may be possible to detach the fixing belt 36A, the fixing roller 34A, and the heating roller 35A collectively without unnecessarily enlarging a shaft diameter of the fixing roller 34A and diameters of the bearings of the fixing roller 34A. Moreover, in this configuration, it may be possible to prevent the fixing belt 36A from being damaged, and improve replaceability of the fixing belt 36A.

In this configuration, when the heating roller holding member 59*b*, one of the heating roller holding members 59*a* and 59*b*, that is, the heating roller holding member 59*b* disposed on opposite ends of the heating roller 35A is detached, the heating roller 35A may be moved along the common cutout part 60C toward the fixing roller 34A side to lower the tension of the fixing belt 36A. As a result, the fixing belt 36A is loosened (relaxed). Hence, when the fixing roller holding members 64 are detached from the respective side plates 60, it may be possible to collectively remove or detach the loosened fixing belt 36A, the heating roller 35A, and the fixing roller 34A from the not-illustrated opening parts of the case 40A. Since the heating roller need not be drawn or pulled from the fixing belt in an axial direction before the fixing belt is detached, it may be possible to prevent the fixing belt from being damaged due to interference between the heating roller and the fixing belt when the heating roller is being drawn or pulled, machine downtime at the replacement of components may be reduced by improving replaceability of the components.

According to the disclosures of the present embodiments, in an image forming apparatus employing an electrophotographic system such as a copier, a printer apparatus, and a facsimile apparatus, there is provided the fixing device exhibiting improved replaceability of the fixing unit and capable of reducing downtime of the machine, and an the image forming apparatus having such a fixing device.

According to the embodiments of the present disclosures, the following excellent effects may be obtained. That is, in the configurations of the disclosed embodiments, since the heating roller need not be drawn out from the fixing belt in an axial direction before the fixing belt is detached, machine downtime due to deficiency in the market or due to replacement of components may be reduced and improving replaceability of the components by preventing damage to the fixing belt caused by interference between the heating roller and the fixing belt while the heating roller is being drawn out or pulled out.

The embodiments of the present invention may be able to facilitate replacement of the fixing belt in the fixing device while preventing the fixing belt from being damaged due to interference between the heating roller and the fixing belt caused by drawing out the heating roller in an axial direction from the fixing belt before removal of the fixing belt. A fixing device 30A according to an embodiment includes two side plates 60 secured on a case 40A of the fixing device. The two side plates 60 are disposed such that the side plates 60 hold opposite ends of a fixing roller 34A and opposite ends of a heating roller 41A inside the case 40A. The fixing device 30A according to the embodiment further includes two pairs of heating roller holding members 59*a* and 59*b*, each pair being configured to pivotally support opposite ends of a hollow shaft 35*aa* of the heating roller 35A. In this configuration, it may be possible to detach the fixing roller 34A, the heating roller 35A, and the fixing belt 36A collectively from the side plate 60 by removing the heating roller holding member 59*b* such that the fixing roller 34A, the heating roller 35A, and the fixing belt 36A may simultaneously be taken out of the case 40A.

The invention is described on the basis of the embodiments described above; however, the invention is not limited to those embodiments. Various alterations and modifications may be made within the scope of the invention.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

The present application is based on and claims the benefit of priority of Japanese Priority Application No. 2013-052554 filed on Mar. 14, 2013, the entire contents of which are hereby incorporated by reference.

What is claimed is:

1. A fixing device comprising:

a fixing belt;

a heating roller and a fixing roller over which the fixing belt is looped, the heating roller and the fixing roller disposed in a substantially vertical direction;

a pressure roller forming a fixing nip with the fixing belt;

a pair of side plates, one of the side plates being disposed on each end of a shaft of the fixing roller and each end of a shaft of the heating roller;

two pairs of heating roller holding members configured to hold corresponding insulating bushing, the insulating bushing being attached to the corresponding ends of the shaft of the heating roller, and corresponding heating roller bearings, the heating roller bearings being attached to the corresponding ends of the shaft of the heating roller, the two pairs of the heating roller holding members being attached to opening parts of the side plates; and heater holding members attached to the corresponding heating roller holding members, wherein:

the heater holding members simultaneously move with the heating roller and the heating roller holding members when the heating roller is moved toward a fixing nip direction, the heating roller holding members support opposite ends of the shaft of the heating roller and pivotally moves the heating roller at each ends of the shaft of the heating roller with respect to the pair of side plates, the heating roller is movable in a downward direction by allowing a tension of the fixing belt to be relaxed and allowing the insulating bushing to pass through the opening parts of the pair of side plates, the heating roller holding members are formed of two separate components such that the heating roller moves along the opening parts formed in the side plates toward the fixing roller, and the side plates having a first opening part configured to hold the heating roller, a second opening part configured to hold the fixing roller, a first cutout part configured to connect the first and the second opening parts, and a second cutout part, the second cutout part being perpendicular to the first cutout part so as to move the fixing roller in a perpendicular direction in relation to the heating roller.

2. The fixing device as claimed in claim 1, wherein the heating roller holding members are capable of moving along surfaces of the side plates, and wherein the heating roller applies tension to the fixing belt by pulling the heating roller holding members via an elastic member.

3. The fixing device as claimed in claim 1, wherein the heating roller is movable by removing one of the heating roller holding members from each end of the shaft of the heating roller, for each of the two pairs, such that the fixing belt, the fixing roller, and the heating roller are removed from the side plates by moving the shaft of the heating roller and the shaft of the fixing roller along cutout parts connecting the opening parts formed in the side plates.

4. The fixing device as claimed in claim 1, wherein the heating roller holding members of each of the two pairs are removed in an axial direction of the heating roller by splitting into two separate components.

5. The fixing device as claimed in claim 3, wherein the cutout parts include respective outlet ports through which the shaft of the heating roller and the shaft of the fixing roller pass toward the fixing roller.

6. The fixing device as claimed in claim 1, wherein the heating roller holding members serve as attaching members for attaching the heating roller and attaching heater holding members configured to hold a heater disposed inside the heating roller.

7. The fixing device as claimed in claim 1, wherein each end of the fixing roller is attached via a fixing roller holding member to a corresponding one of the side plates.

8. The fixing device as claimed in claim 1, wherein the heating roller includes a hollow shaft, and a halogen heater is disposed inside the hollow shaft.

9. An image forming apparatus comprising:

the fixing device as claimed in claim 1.

10. The fixing device as claimed in claim 1, wherein the heating roller holding members are configured to outwardly press the fixing belt by impelling units to apply tension to the fixing belt.

11. The fixing device as claimed in claim 10, wherein the impelling units are springs.

12. The fixing device as claimed in claim 1, wherein the heater holding members hold and supply heating power to the respective ends of the heater of the heating roller.

13. The fixing device as claimed in claim 1, wherein the heater holding members are detachably configured with respect to the heating roller holding members by unfastening a fixing member.

14. The fixing device as claimed in claim 1, wherein the heater holding members are detachably configured with respect to the heating roller holding members by disengaging from fitting parts formed in the heating roller holding members.

15. The fixing device as claimed in claim 1, wherein the fixing roller includes fixing roller bearings configured to axially support opposite ends of the fixing roller.

16. The fixing device as claimed in claim 15, wherein the fixing roller includes fixing roller holding members configured to hold and fasten the fixing roller bearings to the side plates using fastening members.

17. The fixing device as claimed in claim 15, wherein the fixing roller holding members each have sizes large enough to cover opening parts formed in the corresponding side plates.

18. The fixing device as claimed in claim 15, wherein the each of the side plates includes an opening part corresponding to the heating roller, an opening part corresponding to the fixing roller, and a cutout part connecting the opening parts.

* * * * *